US010680324B2

(12) United States Patent
Weinstein et al.

(10) Patent No.: US 10,680,324 B2
(45) Date of Patent: Jun. 9, 2020

(54) ANTENNA SYSTEMS AND DEVICES AND METHODS OF MANUFACTURE THEREOF

(71) Applicant: Zoll Medical Israel Ltd., Kfar Saba (IL)

(72) Inventors: Uriel Weinstein, Mazkeret Batia (IL); Assaf Bernstein, Givat Nilly (IL)

(73) Assignee: ZOLL MEDICAL ISRAEL LTD., Kfar Saba (IL)

( * ) Notice: Subject to any disclaimer, the term of this patent is extended or adjusted under 35 U.S.C. 154(b) by 652 days.

(21) Appl. No.: 15/033,576

(22) PCT Filed: Oct. 29, 2014

(86) PCT No.: PCT/IL2014/050937
§ 371 (c)(1),
(2) Date: Apr. 29, 2016

(87) PCT Pub. No.: WO2015/063766
PCT Pub. Date: May 7, 2015

(65) Prior Publication Data

US 2016/0254597 A1 Sep. 1, 2016

Related U.S. Application Data

(60) Provisional application No. 61/897,036, filed on Oct. 29, 2013.

(51) Int. Cl.
*H01Q 1/52* (2006.01)
*H01Q 19/10* (2006.01)
(Continued)

(52) U.S. Cl.
CPC ..... *H01Q 1/528* (2013.01); *H01Q 1/2283* (2013.01); *H01Q 1/40* (2013.01); *H01Q 9/065* (2013.01);
(Continued)

(58) Field of Classification Search
CPC ..... H01Q 1/528; H01Q 1/2283; H01Q 1/38; H01Q 1/40; H01Q 17/001; H01Q 19/104; H01Q 19/108; H01Q 9/065
See application file for complete search history.

(56) References Cited

U.S. PATENT DOCUMENTS 4,240,445 A 12/1980 Iskander et al.
4,344,440 A 8/1982 Aaby et al.
(Continued)

FOREIGN PATENT DOCUMENTS

CN 101032400 A 9/2007
CN 101516437 A 8/2009
(Continued)

OTHER PUBLICATIONS

Alekseev, S. I., et al. "Human Skin permittivity determined by millimeter wave reflection measurements", Bioelectromagnetics, vol. 28, No. 5, Jul. 1, 2007, pp. 331-339.
(Continued)

*Primary Examiner* — Hoang V Nguyen
(74) *Attorney, Agent, or Firm* — Cooley LLP

(57) ABSTRACT

Embodiments of the present disclosure provide methods, apparatuses, devices and systems related to the implementation of a multi-layer printed circuit board (PCB) radio-frequency antenna featuring, a printed radiating element coupled to an absorbing element embedded in the PCB. The embedded element is configured within the PCB layers to prevent out-of-phase reflections to the bore-sight direction.

30 Claims, 5 Drawing Sheets

(51) Int. Cl.
*H01Q 9/06* (2006.01)
*H01Q 1/40* (2006.01)
*H01Q 1/22* (2006.01)

(52) U.S. Cl.
CPC ..... *H01Q 19/104* (2013.01); *H01Q 19/108* (2013.01)

(56) References Cited

U.S. PATENT DOCUMENTS 4,557,272 A 12/1985 Carr
4,632,128 A 12/1986 Paglione et al.
4,640,280 A 2/1987 Sterzer
4,641,659 A 2/1987 Sepponen
4,774,961 A 10/1988 Carr
4,825,880 A 5/1989 Stauffer et al.
4,926,868 A 5/1990 Larsen
4,945,914 A 8/1990 Allen
4,958,638 A 9/1990 Sharpe
4,986,870 A 1/1991 Frohlich
5,003,622 A 3/1991 Ma et al.
5,109,855 A 5/1992 Guner
5,394,882 A 3/1995 Mawhinney
5,404,877 A 4/1995 Nolan
5,474,574 A 12/1995 Payne et al.
5,540,727 A 7/1996 Tockman et al.
5,549,650 A 8/1996 Bornzin et al.
5,668,555 A 9/1997 Starr
5,704,355 A 1/1998 Bridges
5,766,208 A 6/1998 McEwan
5,807,257 A 9/1998 Bridges
5,829,437 A 11/1998 Bridges
5,841,288 A 11/1998 Meaney et al.
5,865,177 A 2/1999 Segawa
5,967,986 A 10/1999 Cimochowski et al.
6,019,724 A 2/2000 Gronningsaeter et al.
6,061,589 A 5/2000 Bridges et al.
6,064,903 A 5/2000 Riechers et al.
6,093,141 A 7/2000 Mosseri et al.
6,144,344 A 11/2000 Kim
6,161,036 A 12/2000 Matsumara et al.
6,193,669 B1 2/2001 Degany et al.
6,208,286 B1 3/2001 Rostislavovich et al.
6,233,479 B1 5/2001 Haddad et al.
6,267,723 B1 7/2001 Matsumura et al.
6,330,479 B1 12/2001 Stauffer
6,409,662 B1 6/2002 Lloyd et al.
6,454,711 B1 9/2002 Haddad et al.
6,471,655 B1 10/2002 Baura
6,480,733 B1 11/2002 Turcott
6,526,318 B1 2/2003 Ansarinia
6,592,518 B2 7/2003 Denker et al.
6,604,404 B2 8/2003 Paltieli et al.
6,729,336 B2 5/2004 Da Silva et al.
6,730,033 B2 5/2004 Yao et al.
6,755,856 B2 6/2004 Fierens et al.
6,933,811 B2 8/2005 Enokihara et al.
6,940,457 B2 9/2005 Lee et al.
7,020,508 B2 3/2006 Stivoric et al.
7,122,012 B2 10/2006 Bouton et al.
7,130,681 B2 10/2006 Gebhardt et al.
7,184,824 B2 2/2007 Hashimshony
7,191,000 B2 3/2007 Zhu et al.
7,197,356 B2 3/2007 Carr
7,266,407 B2 9/2007 Li et al.
7,267,651 B2 9/2007 Nelson
7,272,431 B2 9/2007 McGrath
7,280,863 B2 10/2007 Shachar
7,454,242 B2 11/2008 Fear et al.
7,474,918 B2 1/2009 Frants et al.
7,479,790 B2 1/2009 Choi
7,493,154 B2 2/2009 Bonner et al.
7,529,398 B2 5/2009 Zwirn et al.
7,570,063 B2 8/2009 Van Veen et al.
7,591,792 B2 9/2009 Bouton
7,697,972 B2 4/2010 Verard et al.
7,719,280 B2 5/2010 Lagae et al.
7,747,302 B2 6/2010 Milledge et al.
7,868,627 B2 1/2011 Turkovskyi
8,032,211 B2 10/2011 Hashimshony et al.
8,211,040 B2 7/2012 Kojima et al.
8,295,920 B2 10/2012 Bouton et al.
8,352,015 B2 1/2013 Bernstein et al.
8,473,054 B2 6/2013 Pillai et al.
8,682,399 B2 3/2014 Rabu
8,882,759 B2 11/2014 Manley et al.
8,938,292 B2 1/2015 Hettrick et al.
8,983,592 B2 3/2015 Belalcazar
8,989,837 B2 3/2015 Weinstein et al.
9,220,420 B2 12/2015 Weinstein et al.
9,265,438 B2 2/2016 Weinstein et al.
9,572,512 B2 2/2017 Weinstein et al.
9,629,561 B2 4/2017 Weinstein et al.
9,788,752 B2 10/2017 Weinstein et al.
10,136,833 B2 11/2018 Weinstein et al.
2002/0032386 A1 3/2002 Sackner et al.
2002/0045836 A1 4/2002 Alkawwas
2002/0049394 A1 4/2002 Roy et al.
2002/0050954 A1 5/2002 Jeong-Kun et al.
2002/0147405 A1 10/2002 Denker et al.
2002/0151816 A1 10/2002 Rich et al.
2003/0036674 A1 2/2003 Bouton
2003/0036713 A1 2/2003 Bouton et al.
2003/0088180 A1 5/2003 Van Veen et al.
2003/0100815 A1 5/2003 Da Silva et al.
2003/0199770 A1 10/2003 Chen et al.
2003/0219598 A1 11/2003 Sakurai
2004/0015087 A1 1/2004 Boric-Lubecke et al.
2004/0073081 A1 4/2004 Schramm
2004/0077943 A1 4/2004 Meaney et al.
2004/0077952 A1 4/2004 Rafter et al.
2004/0249257 A1 12/2004 Tupin et al.
2004/0254457 A1 12/2004 van der Weide
2004/0261721 A1 12/2004 Steger
2005/0038503 A1 2/2005 Greenhalgh et al.
2005/0107693 A1 5/2005 Fear et al.
2005/0192488 A1 9/2005 Bryenton
2005/0245816 A1 11/2005 Candidus et al.
2006/0004269 A9 1/2006 Caduff et al.
2006/0009813 A1 1/2006 Taylor et al.
2006/0025661 A1 2/2006 Sweeney et al.
2006/0101917 A1 5/2006 Merkel
2006/0237223 A1* 10/2006 Chen ..... H05K 1/0218 174/255
2006/0265034 A1 11/2006 Aknine et al.
2007/0016032 A1 1/2007 Aknine
2007/0016050 A1 1/2007 Moehring et al.
2007/0055123 A1 3/2007 Takiguchi
2007/0100385 A1 5/2007 Rawat
2007/0123770 A1 5/2007 Bouton et al.
2007/0123778 A1 5/2007 Kantorovich
2007/0135721 A1 6/2007 Zdeblick
2007/0152812 A1 7/2007 Wong et al.
2007/0156057 A1 7/2007 Cho et al.
2007/0162090 A1 7/2007 Penner
2007/0191733 A1 8/2007 Gianchandani et al.
2007/0263907 A1 11/2007 McMakin et al.
2008/0027313 A1 1/2008 Shachar
2008/0030284 A1 2/2008 Tanaka et al.
2008/0036668 A1* 2/2008 White ..... H01Q 1/20 343/745
2008/0097199 A1 4/2008 Mullen
2008/0129511 A1 6/2008 Yuen et al.
2008/0139934 A1 6/2008 McMorrow et al.
2008/0167566 A1 7/2008 Univer et al.
2008/0169961 A1 7/2008 Steinway et al.
2008/0183247 A1 7/2008 Harding
2008/0200802 A1 8/2008 Bahavaraju et al.
2008/0224688 A1 9/2008 Rubinsky et al.
2008/0269589 A1 10/2008 Thijs et al.
2008/0283282 A1 11/2008 Kawasaki et al.
2008/0294036 A1 11/2008 Hoi et al.
2008/0316124 A1 12/2008 Hook
2008/0319301 A1 12/2008 Busse
2009/0021720 A1 1/2009 Hecker

(56) References Cited

U.S. PATENT DOCUMENTS

| | | | | |
|---|---|---|---|---|
| 2009/0048500 | A1 | 2/2009 | Corn | |
| 2009/0076350 | A1 | 3/2009 | Bly et al. | |
| 2009/0153412 | A1 | 6/2009 | Chiang et al. | |
| 2009/0153433 | A1* | 6/2009 | Nagai | H01Q 1/38 343/893 |
| 2009/0187109 | A1 | 7/2009 | Hashimshony | |
| 2009/0203972 | A1 | 8/2009 | Heneghan et al. | |
| 2009/0227882 | A1 | 9/2009 | Foo | |
| 2009/0240132 | A1 | 9/2009 | Friedman | |
| 2009/0240133 | A1 | 9/2009 | Friedman | |
| 2009/0248450 | A1 | 10/2009 | Fernandez | |
| 2009/0262028 | A1* | 10/2009 | Mumbru | H01Q 5/371 343/702 |
| 2009/0281412 | A1 | 11/2009 | Boyden et al. | |
| 2009/0299175 | A1 | 12/2009 | Bernstein et al. | |
| 2009/0312615 | A1 | 12/2009 | Caduff et al. | |
| 2009/0322636 | A1 | 12/2009 | Brigham et al. | |
| 2010/0004517 | A1 | 1/2010 | Bryenton | |
| 2010/0013318 | A1* | 1/2010 | Iguchi | H05K 1/0218 307/91 |
| 2010/0052992 | A1* | 3/2010 | Okamura | H01Q 1/526 343/700 MS |
| 2010/0056907 | A1 | 3/2010 | Rappaport et al. | |
| 2010/0076315 | A1 | 3/2010 | Erkamp et al. | |
| 2010/0081895 | A1 | 4/2010 | Zand | |
| 2010/0106223 | A1 | 4/2010 | Grevious | |
| 2010/0152600 | A1 | 6/2010 | Droitcour et al. | |
| 2010/0256462 | A1 | 10/2010 | Rappaport et al. | |
| 2010/0265159 | A1 | 10/2010 | Ando et al. | |
| 2010/0305460 | A1 | 12/2010 | Pinter et al. | |
| 2010/0312301 | A1 | 12/2010 | Stahmann | |
| 2010/0321253 | A1 | 12/2010 | Ayala Vazquez et al. | |
| 2010/0332173 | A1 | 12/2010 | Watson et al. | |
| 2011/0004076 | A1 | 1/2011 | Janna et al. | |
| 2011/0009754 | A1 | 1/2011 | Wenzel et al. | |
| 2011/0022325 | A1 | 1/2011 | Craddock et al. | |
| 2011/0040176 | A1 | 2/2011 | Razansky et al. | |
| 2011/0060215 | A1 | 3/2011 | Tupin et al. | |
| 2011/0068995 | A1 | 3/2011 | Baliarda et al. | |
| 2011/0125207 | A1 | 5/2011 | Nabutovsky et al. | |
| 2011/0130800 | A1 | 6/2011 | Weinstein et al. | |
| 2011/0257555 | A1 | 10/2011 | Banet et al. | |
| 2012/0029323 | A1 | 2/2012 | Zhao | |
| 2012/0065514 | A1 | 3/2012 | Naghavi et al. | |
| 2012/0068906 | A1* | 3/2012 | Asher | H01Q 21/0025 343/853 |
| 2012/0098706 | A1 | 4/2012 | Lin | |
| 2012/0104103 | A1 | 5/2012 | Manzi | |
| 2012/0330151 | A1 | 12/2012 | Weinstein et al. | |
| 2013/0041268 | A1 | 2/2013 | Rimoldi et al. | |
| 2013/0053671 | A1 | 2/2013 | Farra | |
| 2013/0069780 | A1 | 3/2013 | Tran et al. | |
| 2013/0090566 | A1 | 4/2013 | Muhlsteff et al. | |
| 2013/0123614 | A1 | 5/2013 | Bernstein et al. | |
| 2013/0184573 | A1 | 7/2013 | Pahlevan et al. | |
| 2013/0190646 | A1 | 7/2013 | Weinstein et al. | |
| 2013/0225989 | A1* | 8/2013 | Saroka | A61B 5/0507 600/430 |
| 2013/0231550 | A1 | 9/2013 | Weinstein et al. | |
| 2013/0297344 | A1 | 11/2013 | Cosentino et al. | |
| 2013/0310700 | A1 | 11/2013 | Ward et al. | |
| 2014/0046690 | A1 | 2/2014 | Gunderson et al. | |
| 2014/0081159 | A1 | 3/2014 | Tao et al. | |
| 2014/0128032 | A1 | 5/2014 | Muthukumar | |
| 2014/0163425 | A1 | 6/2014 | Tran | |
| 2014/0288436 | A1 | 9/2014 | Venkatraman et al. | |
| 2015/0025333 | A1 | 1/2015 | Weinstein et al. | |
| 2015/0150477 | A1 | 6/2015 | Weinstein et al. | |
| 2015/0164349 | A1 | 6/2015 | Gopalakrishnan et al. | |
| 2015/0335310 | A1 | 11/2015 | Bernstein et al. | |
| 2016/0073924 | A1 | 3/2016 | Weinstein et al. | |
| 2016/0198957 | A1 | 7/2016 | Arditi et al. | |
| 2016/0198976 | A1 | 7/2016 | Weinstein et al. | |
| 2016/0213321 | A1 | 7/2016 | Weinstein et al. | |
| 2016/0317054 | A1 | 11/2016 | Weinstein et al. | |
| 2016/0345845 | A1 | 12/2016 | Ravid et al. | |
| 2017/0035327 | A1 | 2/2017 | Yuen et al. | |
| 2017/0135598 | A1 | 5/2017 | Weinstein et al. | |
| 2017/0238966 | A1 | 8/2017 | Weinstein et al. | |
| 2017/0296093 | A1 | 10/2017 | Weinstein et al. | |
| 2019/0046038 | A1 | 2/2019 | Weinstein et al. | |
| 2019/0298208 | A1 | 10/2019 | Weinstein et al. | |

FOREIGN PATENT DOCUMENTS

| | | | |
|---|---|---|---|
| DE | 10008886 | | 9/2001 |
| EP | 1834588 | A1 | 9/2007 |
| EP | 2506917 | A1 | 10/2012 |
| EP | 2 602 870 | A1 | 6/2013 |
| JP | 05-038957 | | 5/1993 |
| JP | 10-137193 | A | 5/1998 |
| JP | 2000-235006 | A | 8/2000 |
| JP | 2001-525925 | A | 12/2001 |
| JP | 2002-094321 | | 3/2002 |
| JP | 2003-141466 | | 5/2003 |
| JP | 2004-526488 | A | 9/2004 |
| JP | 2006-208070 | A | 8/2006 |
| JP | 2006-319767 | A | 11/2006 |
| JP | 2007-061359 | A | 3/2007 |
| JP | 2007-149959 | | 6/2007 |
| JP | 2008-515548 | A | 5/2008 |
| JP | 2008-148141 | A | 6/2008 |
| JP | 2008-518706 | A | 6/2008 |
| JP | 2008-530546 | A | 7/2008 |
| JP | 2008-542759 | A | 11/2008 |
| JP | 2008-545471 | | 12/2008 |
| JP | 2009-514619 | A | 4/2009 |
| JP | 2009-522034 | A | 6/2009 |
| JP | 2010-507929 | | 3/2010 |
| JP | 2010-072957 | | 4/2010 |
| JP | 2010-512190 | A | 4/2010 |
| JP | 2010-530769 | | 9/2010 |
| JP | 2010-537766 | A | 12/2010 |
| JP | 2011-507583 | A | 3/2011 |
| JP | 2011-524213 | A | 9/2011 |
| JP | 2012-090257 | | 5/2012 |
| WO | WO 02/03499 | A1 | 1/2002 |
| WO | WO 2003/009752 | A2 | 2/2003 |
| WO | WO 2006/127719 | A2 | 11/2006 |
| WO | WO 2006/130798 | A2 | 12/2006 |
| WO | WO 2007/017861 | A2 | 2/2007 |
| WO | WO 2007/023426 | A2 | 3/2007 |
| WO | WO 2008/070856 | A2 | 6/2008 |
| WO | WO 2008/148040 | A1 | 12/2008 |
| WO | WO 2009/031149 | A2 | 3/2009 |
| WO | WO 2009/031150 | A2 | 3/2009 |
| WO | WO 2009/060182 | A1 | 5/2009 |
| WO | WO 2009/081331 | A1 | 7/2009 |
| WO | WO 2009/152625 | A1 | 12/2009 |
| WO | WO 2011/067623 | A1 | 6/2011 |
| WO | WO 2011/067685 | A1 | 6/2011 |
| WO | WO 2011/141915 | A2 | 11/2011 |
| WO | WO 2012/011065 | A1 | 1/2012 |
| WO | WO 2012/011066 | A1 | 1/2012 |
| WO | WO 2013/118121 | A1 | 8/2013 |
| WO | WO 2013/121290 | A2 | 8/2013 |
| WO | WO 2015/118544 | A1 | 8/2015 |

OTHER PUBLICATIONS

Ascension Technology Corporation, "TrakSTAR Adds Versatility to Ascension's New Product Line: Desktop Model Joins driveBAY Tracker for Fast Guidance of Miniaturized Sensor", USA, Apr. 7, 2008.

Bell et al., "A Low-Profile Achimedean Spiral Antenna Using an EBG Ground Plane", IEEE Antennas and Wireless Propagation Letters 3, pp. 223-226 (2004).

Beyer-Enke et al., Intra-arterial Doppler flowmetry in the superficial femoral artery following angioplasty., 2000, European Radiology, vol. 10, No. 4, p. 642-649.

(56) References Cited

OTHER PUBLICATIONS

Claron Technology Inc., "MicronTracker 3: A New Generation of Optical Trackers", Canada, 2009.
Czum et al., "The Vascular Diagnostic Laboratory", The Heart & Vascular Institute Newsletter, vol. 1, USA, Winter, 2001.
Extended Search Report for European Application No. 14858165.5, dated Jun. 8, 2017.
Ghosh, et al., Immediate Evaluation of Angioplasty and Stenting Results in Supra-Aortic Arteries by Use of a Doppler-Tipped Guidewire, Aug. 2004, American Journal of Neuroradiology, vol. 25, p. 1172-1176.
Gentili et al., "A Versatile Microwave Plethysmograph for the Monitoring of Physiological Parameters", IEEE Transactions on Biomedical Engineering, IEEE Service Center, Pitscataway, NJ, US, vol. 49, No. 10, Oct. 1, 2002.
Haude et al., Intracoronary Doppler-and Quantitative Coronary Angiography-Derived Predictors of Major Adverse Cardiac Events After Stent Implantation, Mar. 6, 2001, Circulation, vol. 103(9), p. 1212-1217.
Immersion Corporation, "Immersion Introduces New 3D Digitizing Product-MicroScribe G2; Faster Data Transfer, USB Compatibility, New Industrial Design", Press Release, San Jose, USA, Jul. 1, 2002.
International Search Report and Written Opinion, dated Feb. 26, 2015, for International Application No. PCT/IL2014/050937.
Kantarci et al., Follow-up of Extracranial Vertebral Artery Stents with Doppler Sonography., Sep. 2006, American Journal of Roentgenology, vol. 187, p. 779-787.
Lal et al., "Duplex ultrasound velocity criteria for the stented carotid artery", Journal of Vascular Surgery, vol. 47, No. 1, pp. 63-73, Jan. 2008.
Larsson et al., "State Diagrams of the Heart—a New Approach to Describing Cardiac Mechanics", Cardiovascular Ultrasound 7:22 (2009).
Liang, Jing et al., Microstrip Patch Antennas on Tunable Electromagnetic Band-Gap Substrates, IEEE Transactions on Antennas and Propagation, vol. 57, No. 6, Jun. 2009.
Lin, J.C. et al., "Microwave Imaging of Cerebral Edema", Proceedings of the IEEE, IEEE, NY, US, vol. 70, No. 5; May 1, 1982, pp. 523-524.
Lin et al: "Using dual-antenna nanosecond pulse near-field sensing technology for non-contact and continuous blood pressure measurement", Engineering in Medicine and Biology Society (EMBC), 2013 35th Annual International Conference of the IEEE, IEEE, Aug. 28, 2012 (Aug. 28, 2012), pp. 219-222.
Miura et al. "Time Domain Reflectometry: Measurement of Free Water in Normal Lung and Pulmonary Edema," American Journal of Physiology—Lung Physiology 276:1 (1999), pp. L207-L212.
Office Action dated Apr. 5, 2017, for Japanese Patent Application No. 2016-527222, 10 pages.
Paulson, Christine N., et al. "Ultra-wideband radar methods and techniques of medical sensing and imaging" Proceedings of Spie, vol. 6007, Nov. 9, 2005, p. 60070L.
Pedersen, P.C., et al., "Microwave Reflection and Transmission Measurements for Pulmonary Diagnosis and Monitoring", IEEE Transactions on Biomedical Engineering, IEEE Service Center, Piscataway, NJ, US, vol. BME-19, No. 1, Jan. 1, 1978; pp. 40-48.
Polhemus, "Fastrak: The Fast and Easy Digital Tracker", USA, 2008.
Ringer et al., Follow-up of Stented Carotid Arteries by Doppler Ultrasound, Sep. 2002, Neurosurgery, vol. 51, No. 3, p. 639-643.
Solberg et al: "A feasibility study on aortic pressure estimation using UWB radar", Ultra-Wideband, 2009. ICUWB 2009. IEEE International Conference on, IEEE, Piscataway, NJ, USA, Sep. 9, 2009 (Sep. 9, 2009), pp. 464-468.
Yang, F. et al. "Enhancement of Printed Dipole Antennas Characteristics Using Semi-EBG Ground Plane", Journal of Electromagnetic Waves and Application, U.S., Taylor & Francis, Apr. 3, 2006, vol. 8, pp. 993-1006.

* cited by examiner

ANTENNA SYSTEMS AND DEVICES AND METHODS OF MANUFACTURE THEREOF

RELATED APPLICATIONS

This application is a National Stage Entry entitled to and hereby claiming priority under 35 U.S.C. §§ 365 and 371 to corresponding PCT Application No. PCT/IL2014/050937, filed Oct. 29, 2014, entitled "Antenna Systems And Devices And Methods Of Manufacture Thereof", which in turn claims priority under 35 USC § 119 to U.S. provisional patent application No. 61/897,036, filed Oct. 29, 2013, entitled "ANTENNA SYSTEMS FOR USE IN MEDICAL DEVICES AND METHODS OF MANUFACTURE THEREOF," the entire disclosures of which are incorporated herein by reference in their entirety.

This application may contain material that is subject to copyright, mask work, and/or other intellectual property protection. The respective owners of such intellectual property have no objection to the facsimile reproduction of the disclosure by anyone as it appears in published Patent Office file/records, but otherwise reserve all rights.

BACKGROUND

The bore-sight direction of an antenna corresponds to an axis of maximum gain (maximum radiated power). In many cases there is a requirement for thin, directional, wideband or even Ultra-Wideband antennas to have suitable bore-sight performance. One such example is used in medical devices, where the bore-sight direction can be configured for use in/on human tissue, either attached against skin for a non-invasive application, or against muscle or any internal tissue/organ for invasive applications.

In prior art directional antennas, the antenna is designed so that a substantial percentage of the antenna's power is typically radiated in the bore-sight direction. However, in such prior art antennas, some residual power (in some cases, up to about 20%) typically radiates in an opposite direction, which is known as "back-lobe" radiation. These prior art antennas typically include a reflector at a distance of $\lambda/4$ that allow the energy radiated backwards to be properly reflected towards the main lobe. However, in some instances, upon antenna dimensions or the radiated bandwidth do not allow for such structure, other alternatives must be sought to avoid, for example, out-of-phase interference with the main lobe direction propagating waves, and/or avoid back lobe radiation.

SUMMARY OF SOME OF THE EMBODIMENTS

Embodiments of the present disclosure provide methods, apparatuses, devices and systems related to a broadband transceiver slot antenna configured to radiate and receive in the UHF frequency band. Such antenna embodiments may include several slot-shapes configured to optimize one and/or other antenna parameters, such as, for example, bandwidth, gain, beam width. Such embodiments may also be implemented using, for example, a number of different, printed radiating elements such, for example, a spiral and/or dipole.

In some embodiments, antenna systems and devices are provided to achieve reasonable performance with thin directional RF antennas, and in particular, those used in medical devices (for example).

In some embodiments, a system, method and/or device are presented which implements back-lobe, dissipation and/or reflection functionality. Accordingly, in the case of back reflection, some embodiments of the disclosure present a PCB based antenna which includes an absorbing material which helps to eliminate non-in phase reflection. In some embodiments, this may be accomplished by minimizing the thickness dimension of the antenna, typically parallel to the bore-sight. In some embodiments, the noted functionality may be incorporated in internal printed-circuit-board (PCB) layers of an antenna. In some embodiments, the thickness of the antenna is less than $\lambda/4$, and in some embodiments, much less (e.g., is $<<\lambda/4$). To that end, absorbing material included in some embodiments includes a thickness less than $\lambda/4$ (and in some embodiments is $<<\lambda/4$).

In some embodiments, a printed circuit board (PCB) is configured with radio-frequency functionality. The PCB board may comprise a plurality of layers (the PCB structure may also be a separate component in addition to the plurality of layers). In some embodiments, at least one layer (which may be an internal and/or centralized layer) may comprise one or more printed radio-frequency (RF) components and at least one embedded element comprising at least one of a magnetic material and an absorbing material.

In some embodiments, the PCB further comprises an antenna, which may comprise a wideband bi-directional antenna. The PCB may additionally or alternatively include a delay line.

In some embodiments, the PCB can further include a temperature resistant absorbing material, e.g., which may be resistant to temperatures fluctuations between 150° C. and 300° C., for example.

In some embodiments, the absorbing material may be covered with a conductive material comprising, for example, at least one of a row of conductive vias, a coated PCB layer(s), and other structure(s). Additionally, the absorbing material may be placed above the radiator layer of at least one antenna, embedded (for example) in the plurality of layers comprised by the PCB. In some further embodiments, the absorbing material can be surrounded by a conductive hedge structure.

In some embodiments, the PCB (e.g., one or more, or all of the layers thereof) may be made of at least one of a ceramic, silicon based polymer (i.e., a high temp polymer), and ferrite material.

In some embodiments, the PCB structure includes a plurality of electronic components. Such components may comprise radio-frequency generating components, data storage components (for storing data corresponding to reflected radio waves), and processing components (for analyzing collected data and/or other data).

In some embodiments, the PCB can include a directional antenna with a radiating element backed by a metallic reflector. The distance between the radiating element and the metallic reflector can configured, for example, to be less than about a quarter of the wavelength of a received or transmitted RF signal, and in some embodiments, substantially less (e.g., in some embodiments between greater than 0 and about 15% the wavelength, and in some embodiments, between greater than 0 and about 10% the wavelength).

In some embodiments, the PCB may further comprise a cavity resonator, a radiating element, and a plurality of rows of conducting vias. The resonator may be arranged behind the radiating element—being separated by at least one of the plurality of rows of conducting vias. The radiating element may include internal edges having a coating of conductive material.

In some embodiments, the PCB may include one or more openings configured to release gas pressure during a lamination process to produce the PCB. The one or more openings may comprise vias, channels and/or slots. The vias may be configured as through-hole vias, blind vias and/or buried vias, for example. The one or more openings may be filled with a conducting or a non-conductive material.

In some embodiments, the RF structures may comprise delay lines, circulators, filters and the like.

DETAILED DESCRIPTION OF SOME OF THE EMBODIMENTS

Figure 1:
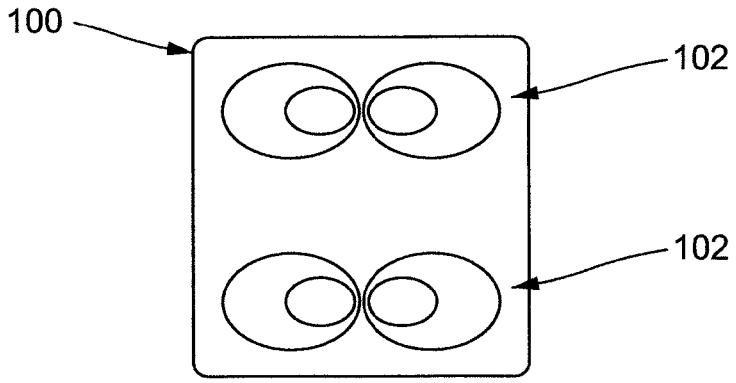
FIG. 1 shows a representation of an antenna front layer, including transmitting and receiving antenna, according to some embodiments.

FIG. 1 illustrates a representation of an antenna front layer of a PCB structure, including a transmitting and receiving antenna(s), according to some embodiments. The antenna may be a planar antenna comprising a radiator printed on the external layer of the PCB. The antenna (as well as other components included with and/or part of the PCB) may be manufactured from a variety of materials including at least one of, for example, ceramic, polymers (e.g., silicon based or other high temperature resistant polymer), and ferrite. In some embodiments, the shape of the PCB and/or antenna(s) may be optimized so as to enhance at least one of characteristic of the apparatus, including, for example, antenna gain (e.g., at different frequencies in the bandwidth).

Figure 6:
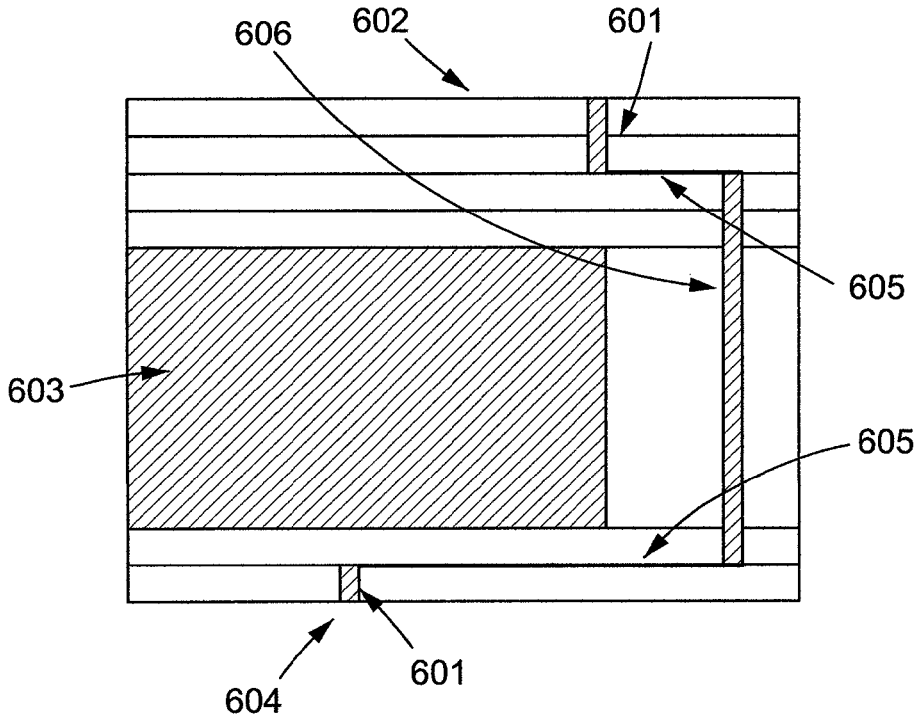
FIG. 6 shows a representation of a component side to antenna transmission line, according to some embodiments.

In some embodiments, the antenna may comprise an antenna array 100 which includes a plurality of antennas 102 (e.g., two or more antennas), and one or more of antennas 102 may comprise at least one of a wideband directional antenna(s) and an omnidirectional antenna(s). In the embodiments illustrated in FIG. 1, the antenna array may include at least one transmitting antenna (Tx) for radar pulse transmission, and at least one receiving antenna (Rx). In some embodiments, excitation of an antenna may be achieved via an internal feed line arranged within one of the PCB's layers (as shown in FIG. 6), without use of, for example, any radio-frequency (RF) connectors.

Accordingly, by implementing the antenna and electronics on a single printed circuit board (PCB) structure, a reduction in cost and size can be realized, as well as an elimination of the need for RF connectors.

Figure 2:
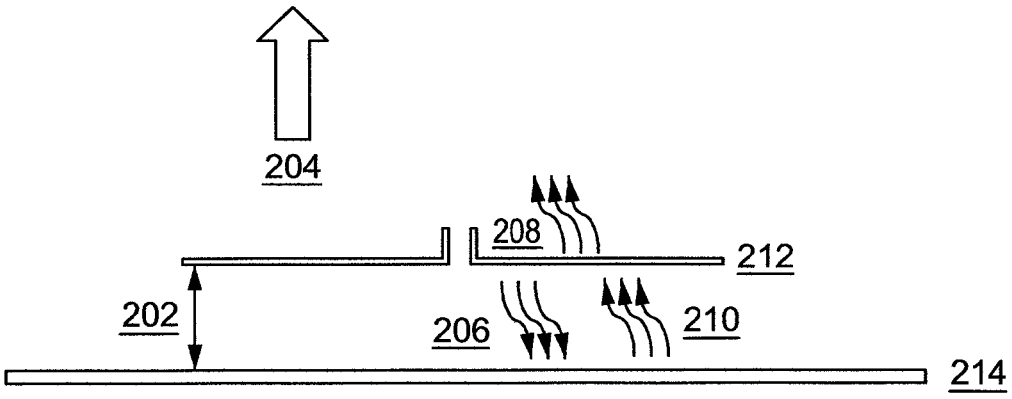
FIG. 2 shows a representation of a directional antenna with a radiating element backed metallic reflector, according to some embodiments.

FIG. 2 illustrates a representation of a directional antenna with a radiating element backed by a metallic reflector according to some embodiments of the disclosure. The directional antenna with a main lobe direction 204 comprises a radiating element 212, which may be positioned at a $\lambda/4$ distance 202 from a backed metallic reflector 214 wherein $\lambda$ represents the wavelength of the RF signal 206. The directional antenna can be configured such that a phase inversion occurs when an RF signal/electromagnetic wave 206 reflects on the reflector 214. In some embodiments, the reflector 214 can comprise a metallic material including at least one of, for example, copper, aluminum, a plated conductive element and/or the like.

In some embodiments, arranging radiating element 212 at a distance $\lambda/4$ from the reflector 214, the in-phase reflected waves 210 are coherently summed to signals/waves 208 transmitted from the radiating element 212 and propagated in the opposite direction to that of the reflector 214 direction. In such cases, a maximum efficiency may be achieved by configuring the distance 202 between the radiating element 212 and the reflector 214.

Accordingly, when the reflector 214 is arranged at a distance equivalent to $d \ll \lambda/4$ (i.e., a distance that is much less than the transmitted RF wavelength's divided by four) such that, the reflected waves 210 are summed out-of-phase with the signals 208 propagated from the radiating element 212, which can substantially degrade the antenna's performance, up to, for example, a full main lobe cancelation.

In some embodiments, where the distance d is $\ll \lambda/4$, an absorptive material may be arranged between the radiating element 212 and the reflector 214, enabling proper gain performance at the main lobe direction of some embodiments in the ultra-wide band bandwidth, and moreover, may substantially reduce the antenna's thickness. In some embodiments, depending on the required performance, the thickness of an antenna may be reduced up to a factor of ten or more.

Figure 3:
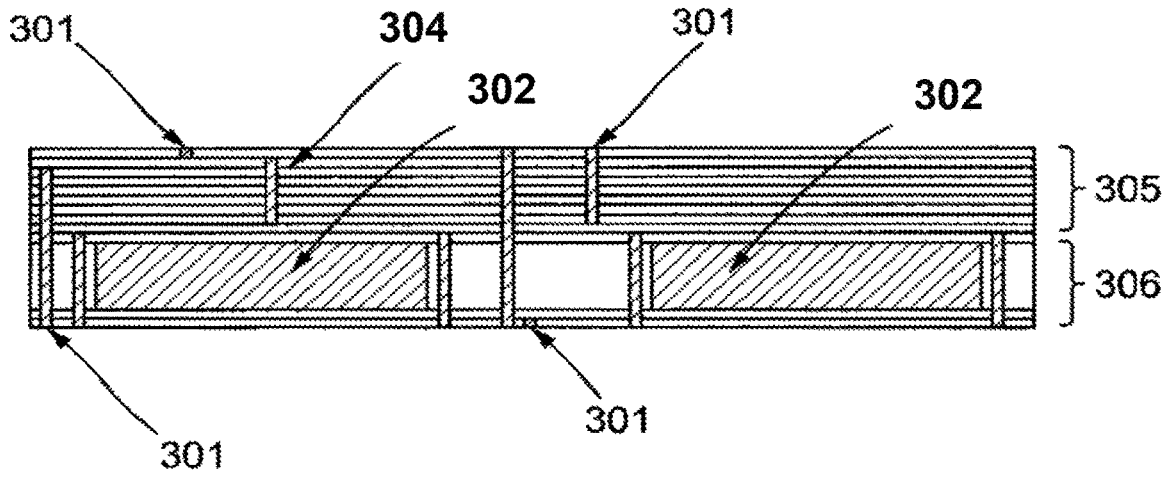
FIG. 3 shows a representation of an antenna layers structure, according to some embodiments.

FIG. 3 illustrates a via to conductive layer contact, intended to create a conductive enclosure covering an absorbing material. In some embodiments, a via conductive layer includes an embedded temperature resistant absorbing material 302, for example, which may comprise magnetically loaded silicon rubber. Such a material can comply with thermal requirements imposed by PCB production processes and assembly of electronic components. For example, the material 302 can be configured to endure the exposure to high temperatures during the production processes; such temperatures can fluctuate between 150° C. and 300° C. depending on the process. In some embodiments, the via conductive layer connection point 306 can be an extension of the conductive cover placed over the embedded absorbing material 302. In some embodiments, a blind via 304, can be part of the conductive cover placed over the embedded absorbing material. Item 301 also comprises a blind via.

The absorbing material 302 can be used to dissipate back-lobe radiation, can be placed above the antenna radiator layer embedded in the internal layers of the PCB structure. In some embodiments, the shape and thickness of this absorbing material is optimized for example larger dimensions may improve performance for lower frequencies. For example a thicker absorbing material improves performance but increases the antenna's dimensions. The absorbing material may comprise and/or be based on a dissipater made of a ferrite material and/or flexible, magnetically loaded silicone rubber non-conductive materials material such as Eccosorb, MCS, and/or absorbent materials, and/or electrodeposited thin films for planar resistive materials such as Ohmega resistive sheets.

Figure 4:
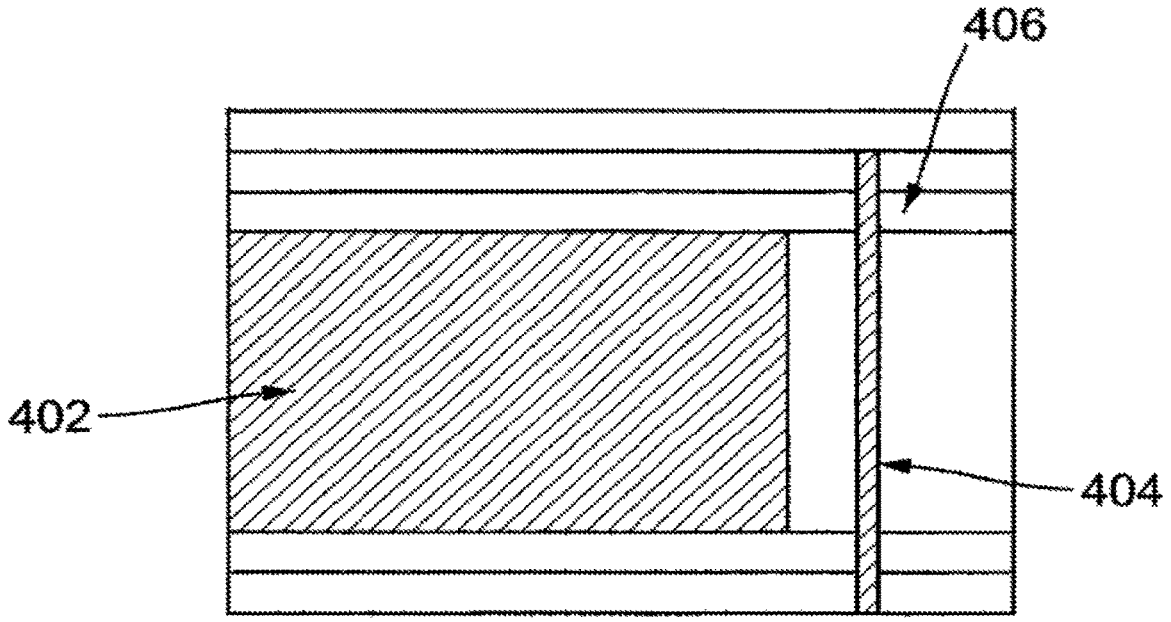
FIG. 4 shows a representation of an antenna layers structure, via to copper contact, according to some embodiments.

FIG. 4 provides a detailed zoomed-in view of details from FIG. 3, illustrating a representation of an antenna and layered PCB structure according to some embodiments of the disclosure. As shown, the PCB structure may include one or more layers having an embedded absorbing material 402 (or the one or more layers may comprise adsorbing material, with the one more layers being internal to the PCB), and a plurality of additional layers. In some embodiments, the layers can be configured to be substantially flat with little to no bulges. The via holes 404 (e.g., blind vias) may be electrically connected to their target location, via to conductive layer connection point 406 (for example), and may be configured in a plurality of ways including, for example, through-hole vias, blind vias, buried vias and the like. In some embodiments, the absorbing material 404 can be configured to come into contact with the antenna's PCB however this configuration is not essential for the antennas operation.

Figure 5:
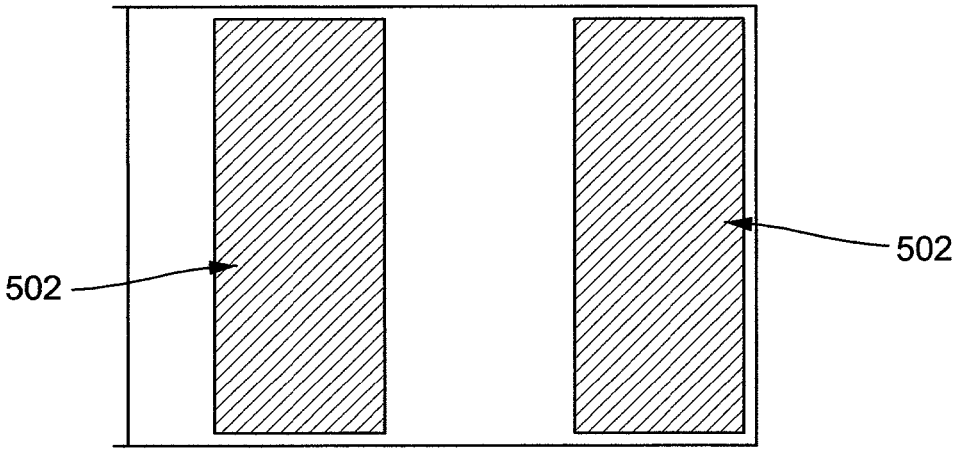
FIG. 5 shows a representation of a dissipating material, insight structure, top view, according to some embodiments.

FIG. 5 illustrates a representation of the internal structure/top-view of a dissipating material according to some embodiments. Specifically, the internal structure of the antenna PCB may comprise an embedded absorbing material 502 positioned over one or more printed radiating elements (and in some embodiments, two or more), for example, a spiral and/or dipole.

FIG. 6 illustrates a representation of the signal transmission from an electronic circuit to an antenna PCB, according to some embodiments. In some embodiments, a signal can be fed from the electronic components layer 602 in to a blind via 601. Thereafter, the signal can be transmitted through the transmission line 605 (which may comprise of a plurality of layers of the PCB structure), to the blind via 606, and further to transmission line 605 and blind via 601 which feeds a radiating element and/or antenna 604. Additionally, an absorbing layer 603 may be included.

Figure 7:
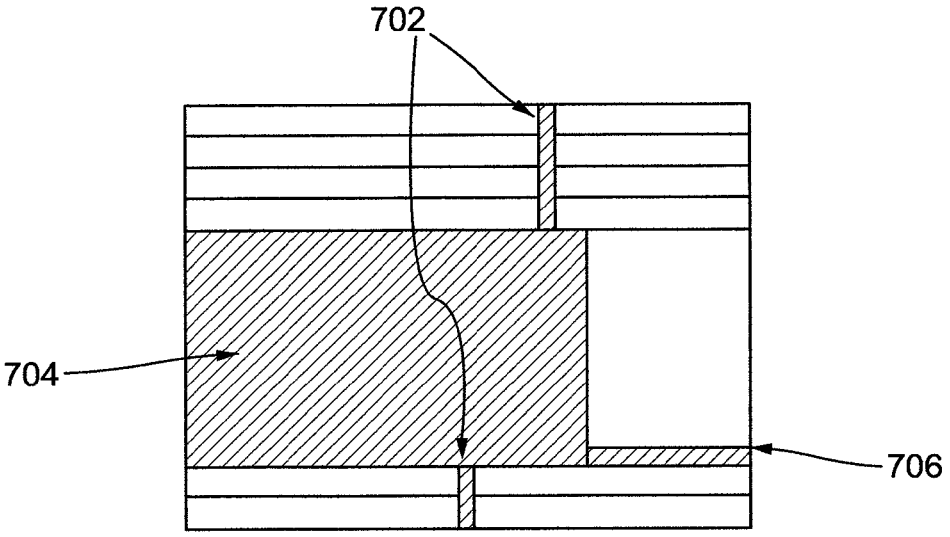
FIG. 7 shows a representation of a gas release mechanism, according to some embodiments.

FIG. 7 illustrates a representation of a gas release mechanism, according to some embodiments. For example, the structure may comprise one or more of openings including, for example, a gas pressure release vent or opening 702, another gas pressure release aperture is depicted as 706 configured to release gas pressure during, for example, a lamination process needed to produce the final PCB structure (see description of FIG. 8 below (The lamination process is standard. Embedding materials inside the PCB is rare and we are not aware of venting anywhere. In some embodiments, the one or more openings 702 and 706 may comprise vias, channels and/or slots. In some embodiments, the one or more openings can be filled with a material after the lamination or assembly process, for example with a conducting or a non-conducting material for example: epoxy, conductive or not. Absorbing layer 704 may also be included.

Figure 8:
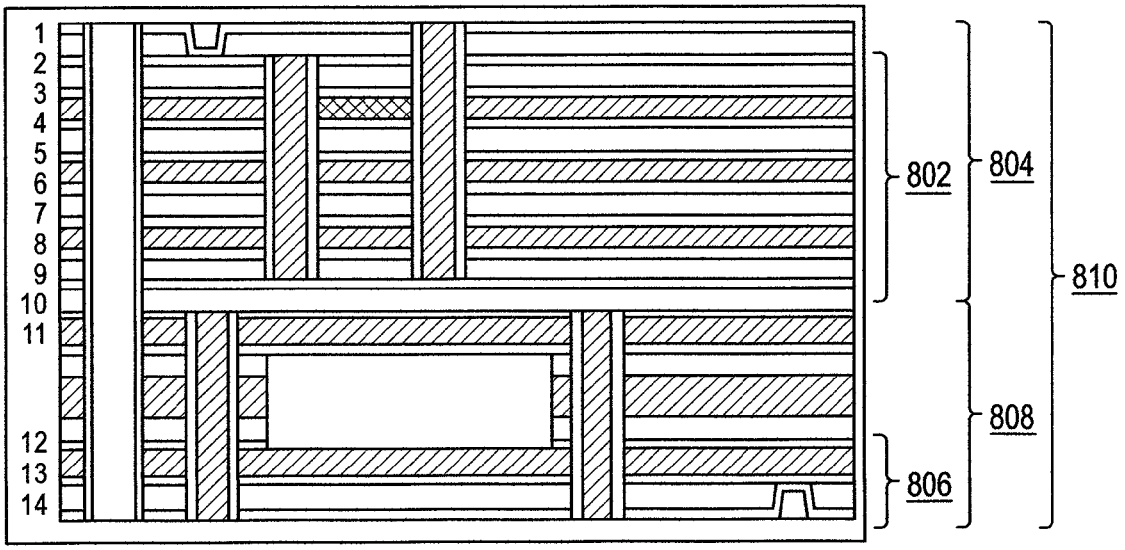
FIG. 8 shows a representation of the laminating process stages, according to some embodiments.

FIG. 8 illustrates a lamination process according to some embodiments of the present disclosure. In such embodiments, a plurality of layers may be laminated. For example, the layers (e.g., groups of layers) represented in FIG. 8 may be laminated in the following order (for example): 802, 806, 804, 808, and 810. One or more, and preferably all, of stacks (items 1-9, i.e., layer 804 and items 10-14, i.e., layer 808) which may include an absorbing material (e.g., in a middle layer), may be laminated together. In the figure, lamination 808, which includes layers 11 and 12, may include an absorbing material. In some embodiments, a last lamination 810 of previous laminations may be performed, and several steps may be implemented in succession to perform this lamination, such as, for example, temperature reduction, and configuring gas flow channels/tunnels (e.g., gas pressure release openings 702, and/or grass pressure release aperture 706 in FIG. 7).

Figure 9:
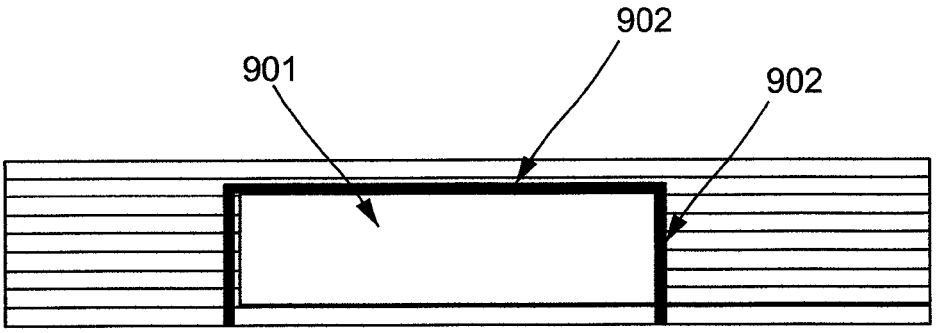
FIG. 9 illustrates a representation of a metallic wall or hedge surrounding an absorbing material, according to some embodiments.

FIG. 9 illustrates a representation of a metallic wall or hedge surrounding an absorbing material, according to some embodiments. As shown, the absorbing material 901 can be surrounded by a metal boundary or hedge 902, configured either as a metallic wall immediately surrounding the absorbing material and/or in direct contact with a plurality of conductive materials (e.g., such as a metallic coating of PCB or rows of conducting vias). In some embodiments, the conductive material can be any conductive material including but not limited to copper, gold plated metal and the like. Such a conductive material can generate a reflection coefficient and/or loss which improves antenna's match to a transmission line via holes placed around the circumference of the buried absorber/dissipater. In some embodiments, a metallic conductive covering layer of (for example) copper and/or gold plated material may be provided above the absorbing material to create a closed electromagnetic cavity structure.

Figure 10:
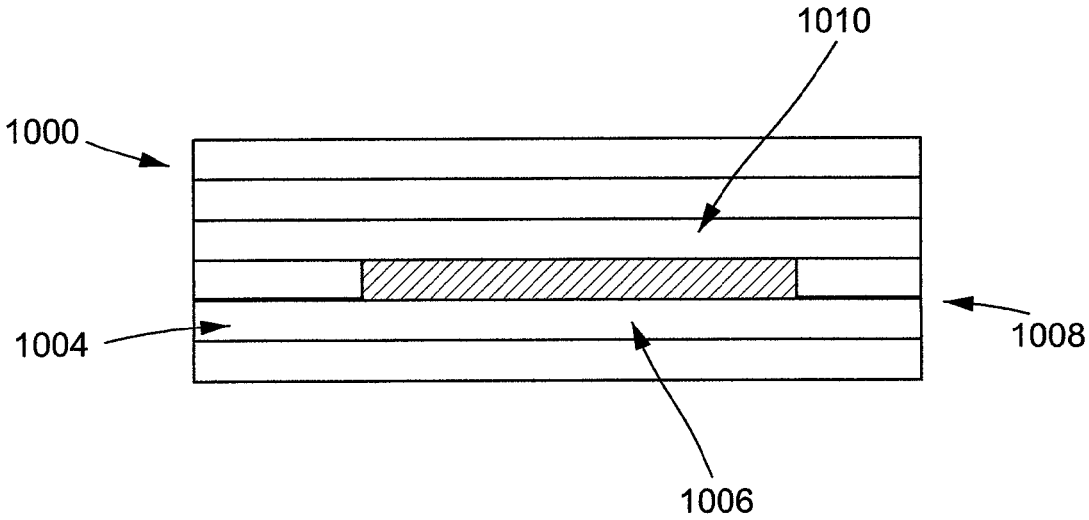
FIG. 10 shows an example of a delay line implemented with embedded dielectric material, according to some embodiments.

FIG. 10 illustrates an exemplary implementation of a delay line 1006 of a PCB structure 1000, the delay line configured to produce a specific desired delay in the transmission signal between two RF transmission lines 1004 and 1008, implemented with an embedded dielectric material 1010. In some embodiments, basic RF components including, but not limited to, a delay line a circulator and/or a coupler and the like RF components, can be implemented as one or more printed layers within a PCB structure 1000. In some embodiments, this may be accomplished in combination with at least one of a dielectric, magnetic, and absorbing materials embedded in the PCB. Such embedded devices may include, for example, delay lines, circulators, filters and the like. For example, by using high Dk material above delay line, its length can be minimized. Unwanted coupling and/or unwanted radiation reduction can also be achieved by using PCB embedded absorbing or termination material.

Example embodiments of the devices, systems and methods have been described herein. As may be noted elsewhere, these embodiments have been described for illustrative purposes only and are not limiting. Other embodiments are possible and are covered by the disclosure, which will be apparent from the teachings contained herein. Thus, the breadth and scope of the disclosure should not be limited by any of the above-described embodiments but should be defined only in accordance with features and claims supported by the present disclosure and their equivalents. Moreover, embodiments of the subject disclosure may include methods, systems and devices which may further include any and all elements/features from any other disclosed methods, systems, and devices, including any and all features corresponding to antennas, including the manufacture and use thereof. In other words, features from one and/or another disclosed embodiment may be interchangeable with features from other disclosed embodiments, which, in turn, correspond to yet other embodiments. One or more features/elements of disclosed embodiments may be removed and still result in patentable subject matter (and thus, resulting in yet more embodiments of the subject disclosure). Furthermore, some embodiments of the present disclosure may be distinguishable from the prior art by specifically lacking one and/or another feature, functionality or structure which is included in the prior art (i.e., claims directed to such embodiments may include "negative limitations").

Any and all references to publications or other documents, including but not limited to, patents, patent applications, articles, webpages, books, etc., presented anywhere in the present application, are herein incorporated by reference in their entirety.

The invention claimed is:

1. A printed circuit board (PCB), the PCB comprising:

a PCB structure comprising a plurality of layers, wherein at least one layer is arranged within the PCB structure and comprises one or more radio-frequency (RF) radiating elements;

a conductive structure backing the one or more RF radiating elements; and an absorbing material embedded within the PCB structure between the conductive structure and the one or more RF radiating elements and configured to absorb radiation of the one or more RF radiating elements, wherein radiating elements include a transmitting antenna and a receiving antenna, and the absorbing material comprises a first absorbing material arranged over the transmitting antenna and a second absorbing material arranged over the receiving antenna.

2. The PCB of claim 1, wherein at least one of the transmitting antenna and the receiving antenna comprises a wideband directional antenna.

3. The PCB of claim 1, wherein a separation distance between the one or more radiating elements and the conductive structure is less than a quarter of the wavelength of the radiation of the one or more RF radiating element.

4. The PCB of claim 1, wherein the absorbing material is configured to eliminate non-in phase reflection radiation.

5. The PCB of claim 1, wherein the absorbing material is configured to absorb back-lobe radiation from the at least one of the one or more RF radiating elements.

6. The PCB of claim 1, wherein the absorbing material is temperature resistant.

7. The PCB of claim 1, wherein the absorbing material comprises at least one of a ferrite material, a magnetic material, a magnetically loaded non-conductive material and a dissipative electrodeposited thin film for planar resistive materials.

8. The PCB of claim 1, wherein the absorbing material comprises a magnetically loaded silicon rubber material.

9. The PCB of claim 1, wherein at least one of the plurality of layers include a ceramic, ferrite or a polymer.

10. The PCB of claim 1, wherein the conductive structure includes one or more vias.

11. The PCB of claim 10, wherein the one or more vias are arranged in at least one row.

12. The PCB of claim 10, wherein the one or more vias comprise at least one of through-hole vias, buried vias and blind vias.

13. The PCB of claim 1, further comprising a cavity arranged behind the radiating element being enclosed within a structure constructed of at least one of the one or more vias.

14. The PCB of claim 1, further comprising an electrical component including at least one of: an impedance matching circuitry, an RF front-end circuitry and an RF transceiver.

15. The PCB of claim 1, wherein the conductive structure includes at least one of a copper layer and one or more vias.

16. The PCB of claim 1, wherein the PCB structure comprises an embedded dielectric material.

17. The PCB of claim 1, further comprising one or more RF transmission lines.

18. The PCB of claim 17, further comprising a delay line configured to produce a specific desired delay in transmission of a signal between two of the one or more RF transmission lines.

19. The PCB of claim 1, further comprising at least one of: one or more circulators and one or more filters.

20. The PCB of claim 1, further comprising a termination material.

21. The PCB of claim 1, wherein a thickness of the absorbing material is less than about a quarter of a wavelength of the radiation.

22. The PCB of claim 1, wherein a thickness of the one or more RF radiating elements is less than about a quarter of a wavelength of the radiation.

23. A medical device comprising:

a printed circuit board (PCB) structure, the PCB structure including:

a plurality of PCB layers, wherein at least one layer is arranged within the PCB structure and comprises one or more radio-frequency (RF) radiating elements comprising at least a transmitting antenna and a receiving antenna;

a conductive structure backing the one or more RF radiating elements; and one or more absorbing materials embedded within the PCB structure between the conductive structure and the one or more RF radiating elements and configured to absorb radiation of the one or more RF radiating elements, wherein the absorbing material comprises a first absorbing material arranged over the transmitting antenna and a second absorbing material arranged over the receiving antenna.

24. The medical device of claim 23, wherein:

at least one of the transmitting antenna and the receiving antenna comprises a wideband directional antenna, a separation distance between the one or more radiating elements and the conductive structure is less than a quarter of the wavelength of the radiation of the one or more RF radiating element, the absorbing material is configured to eliminate non-in phase reflection radiation, the absorbing material is configured to absorb back-lobe radiation from the at least one of the one or more RF radiating elements, the absorbing material is temperature resistant, the absorbing material comprises at least one of a: ferrite material, a magnetic material, a magnetically loaded non-conductive material, a magnetically loaded silicon rubber material, and a dissipative electrodeposited thin film for planar resistive materials, and at least one of: the plurality of layers include a ceramic, ferrite and a polymer, and the conductive structure includes one or more vias.

25. The medical device of claim 24, wherein upon the conductive structure including one or more vias, the one or more vias are arranged at least one of: in at least one row, and the one or more vias comprise at least one of through-hole vias, buried vias and blind vias.

26. The medical device of claim 23, further comprising at least one of:

a cavity arranged behind the radiating element being enclosed within a structure constructed of at least one of the one or more vias, an electrical component including at least one of an impedance matching circuitry, an RF front-end circuitry and an RF transceiver, one or more RF transmission lines, a delay line configured to produce a specific desired delay in transmission of a signal between two of the one or more RF transmission lines, and a termination material.

27. The medical device of claim 23, wherein at least one of:

the conductive structure includes at least one of a copper layer and one or more vias, and the PCB structure comprises an embedded dielectric material.

28. The medical device of claim 23, further comprising at least one of: one or more circulators and one or more filters.

29. The medical device of claim 23, wherein a thickness of the absorbing material is less than about a quarter of a wavelength of the radiation.

30. The medical device of claim 23, wherein a thickness of the one or more RF radiating elements is less than about a quarter of a wavelength of the radiation.

* * * * *